US007036512B2

(12) United States Patent
Harnois

(10) Patent No.: US 7,036,512 B2
(45) Date of Patent: May 2, 2006

(54) DISMOUNTABLE MULTI-POSITION STANDER

(75) Inventor: Jacques Harnois, Sainte-Mélanie (CA)

(73) Assignee: Prodije 9061-7457 Quebec Inc., (CA)

( * ) Notice: Subject to any disclaimer, the term of this patent is extended or adjusted under 35 U.S.C. 154(b) by 389 days.

(21) Appl. No.: 10/608,672

(22) Filed: Jun. 27, 2003

(65) Prior Publication Data

US 2004/0267175 A1 Dec. 30, 2004

(51) Int. Cl.
*A61G 15/00* (2006.01)

(52) U.S. Cl. ..... 128/845; 601/24

(58) Field of Classification Search ..... 128/845; 280/87.021, 87.05, 47.4, 47.34, 47.38; 482/91, 482/142, 143, 144, 145; 601/5, 24, 33
See application file for complete search history.

(56) References Cited

U.S. PATENT DOCUMENTS

| | | | | |
|---|---|---|---|---|
| 2,295,006 A | | 9/1942 | Philips | 5/82 |
| 4,029,089 A | | 6/1977 | Mulholland | 128/80 R |
| 4,111,445 A | | 9/1978 | Haibeck | 280/79.3 |
| 4,307,715 A | | 12/1981 | Fante | 128/80 G |
| 4,620,714 A | | 11/1986 | Davis | 280/242 R |
| 4,758,000 A | * | 7/1988 | Cox | 473/208 |
| 4,968,050 A | | 11/1990 | Kendrick et al. | 280/250.1 |
| 5,108,202 A | | 4/1992 | Smith | 297/330 |
| 5,265,689 A | | 11/1993 | Kauffmann | 180/65.5 |
| D347,604 S | | 6/1994 | Ernst et al. | D12/132 |
| 5,324,247 A | * | 6/1994 | Lepley | 482/134 |
| 5,340,139 A | | 8/1994 | Davis | 280/304.1 |
| D356,527 S | | 3/1995 | Wohnsen et al. | D12/128 |
| 5,484,151 A | | 1/1996 | Tholkes | 280/250.1 |
| 5,489,258 A | | 2/1996 | Wohnsen et al. | 602/5 |
| D368,243 S | | 3/1996 | Nestor et al. | D12/128 |
| 5,520,402 A | | 5/1996 | Nestor et al. | 280/250 |
| 5,618,055 A | | 4/1997 | Mulholland | 280/641 |

* cited by examiner

*Primary Examiner*—Henry Bennett
*Assistant Examiner*—Camtu Nguyen
(74) *Attorney, Agent, or Firm*—St. Onge Steward Johnston & Reens LLC

(57) ABSTRACT

The dismountable multi-position stander has a carriage, a body support assembly, and a mounting assembly detachably mounting the body support assembly onto the carriage in a single coupling direction. The mounting assembly has upper and lower mounting elements detachably engaging with each other in the coupling direction. The lower and upper mounting elements are respectively connected to the carriage and the body support assembly.

23 Claims, 11 Drawing Sheets

DISMOUNTABLE MULTI-POSITION STANDER

FIELD OF THE INVENTION

The invention relates to orthopedic devices and more particularly to a dismountable multi-position stander for supporting a user in a prone, supine or vertical position or in a desired inclined position.

BACKGROUND OF THE INVENTION

Orthopedic devices known as standers allow a person, often a child but also adults as well, with ambulatory problems, to stand in a vertical or quasi-vertical position. The person thus has his/her hands free for practicing activities such as drawing, writing, playing, working, interacting with other people, etc. The inability to stand up and stay in a vertical position for interacting with the environment or other persons often result in psychological problems considerably affecting the person's standard of living. Besides the psychological effects on the person, physical problems also arise due to the absence of mobility. Bones and muscles developments, for example, are affected by the lack of weight-bearing effects.

Standers are therefore often used today to make up for these problems. Furthermore, some standers are mobile so the user can be moved or transported where he/she wants to be. The standers tend to considerably decrease psychological and physical effects from which the person with ambulatory problems generally suffers.

One important problem with the current standers is that they either cannot be easily disassembled by a person alone, e.g. for transportation in a vehicle, or cannot be disassembled at all. Furthermore, their design is often complex and they are considerably heavy. Consequently, it can be a difficult task for a person alone to remove the body support unit from the base, and to eventually mount it back in place before use. Moreover, when disassembled, many adjustments made to the various parts of the stander to accommodate the user are lost. When reassembling the stander, all those adjustments must be done again.

Known in the art is U.S. Pat. No. 4,029,089 showing a pediatric stander formed of a post assembly having three legs attached to a supporting base with wheels. Once the post assembly is removed from the supporting base, many of the possible adjustments of the stander are lost. The mounting of the three legs of the post assembly with the supporting base is very difficult for a person alone. Indeed, the legs must all be properly aligned with the mounting brackets on the base, not to mention the relatively heavy weight of the disassembled upper part. Also, the stander has no supine position capabilities.

Also known in the art are U.S. Pat. No. 2,295,006 (Philips), U.S. Pat. No. 4,307,715 (Fante), U.S. Pat. No. 4,111,445 (Haibeck), U.S. Pat. No. 4,620,714 (Davis), U.S. Pat. No. 4,968,0 (Kendrick et al.), U.S. Pat. No. 5,108,202 (Smith), U.S. Pat. No. 5,484,151 (Tholles), U.S. Pat. No. 5,265,689 (Kauffmann), U.S. Pat. No. 5,340,139 (Davis), U.S. Pat. No. 5,489,258 (Wohnsen et al.), U.S. Pat. No. 5,520,402 (Nestor et al.) and U.S. Pat. No. 5,618,055 (Mulholland) and U.S. Design Pat. No. 347,604 (Ernst et al.), U.S. Design Pat. No. 356,527 (Wohnsen et al.) and U.S. Design Pat. No. 368,243 (Nestor et al.) which provide examples of orthopedic devices for supporting a user in a stand-up position. Some of the devices described in those US patents and US Design patents can be folded, but cannot be disassembled easily.

Generally, different sizes of standers are necessary because their adaptation range to the user growth and weight is limited.

Also, the child or the adult generally stands in an unnatural elevated position over the ground level due to the stander design. This situation might result in the user feeling that he/she is different and apart from the people he/she interacts with.

SUMMARY OF THE INVENTION

An object of the present invention is to provide a dismountable multi-position stander which has a body support assembly which can be easily dismounted from and mounted back onto a carriage by a person alone.

Another object of the invention is to provide such a stander which does not loose its possible adjustments and settings when dismounted and mounted back.

Another object of the present invention is to provide such a stander which has a strong construction, an effective design and a larger adaptation range.

Another object of the present invention is to provide such a stander in which the user may stand up close to the ground level.

Another object of the present invention is to provide such a stander which can support a user in supine and prone positions as well as in vertical and inclined positions.

According to the present invention, there is provided a dismountable multi-position stander comprising a carriage, a body support assembly, and a mounting assembly detachably mounting the body support assembly onto the carriage in a single coupling direction. The mounting assembly has upper and lower mounting elements detachably engaging with each other in the coupling direction. The lower and upper mounting elements are respectively connected to the carriage and the body support assembly.

The dismountable multi-position stander may advantageously comprise a pivoting arrangement between the body support assembly and the upper mounting element, so that the support assembly is pivotable between first and second tilt positions with respect to the carriage.

The dismountable multi-position stander may advantageously comprise a pivoting arrangement for adjusting an operative angle of the mounting assembly and, as a result, of the coupling direction.

BRIEF DESCRIPTION OF THE DRAWINGS

A detailed description of preferred embodiments will be given herein below in reference with the following drawings, in which like numbers refer to like elements.

DETAILED DESCRIPTION OF THE PREFERRED EMBODIMENTS

Figure 1:
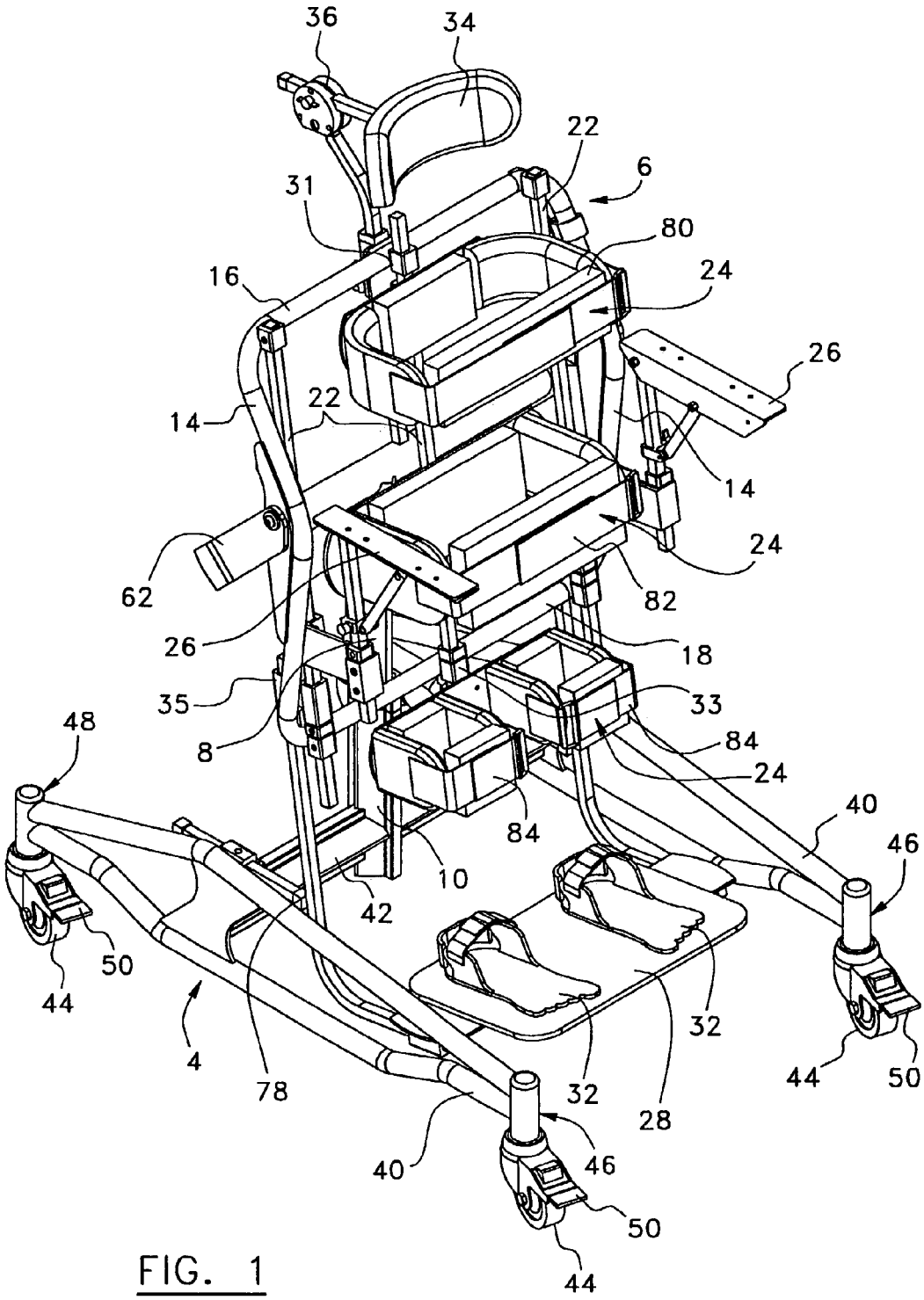
FIGS. 1 and 2 are schematic perspective views of a dismountable multi-position stander according to the present invention, in different operating configurations.
Figure 2:
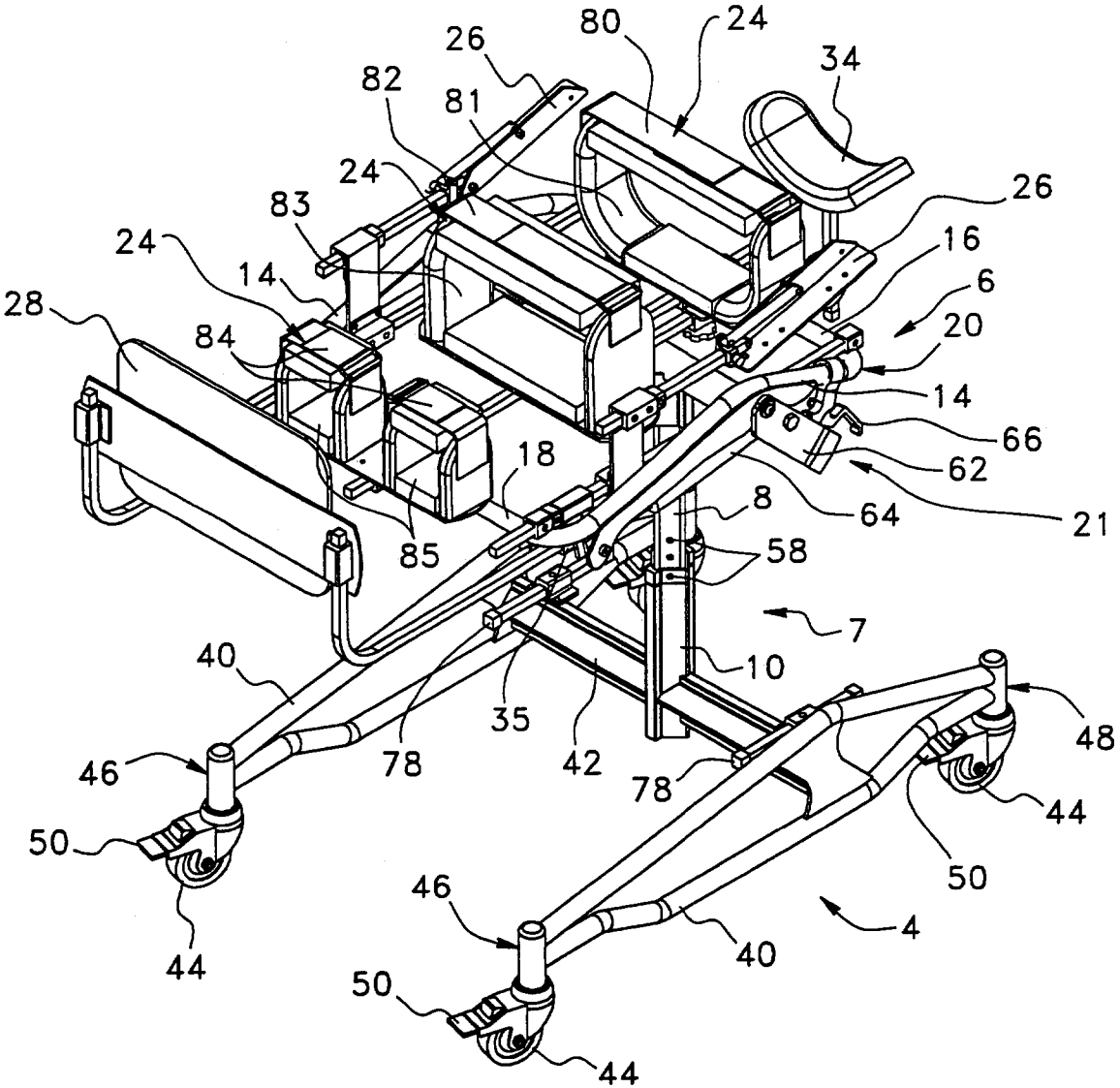
Figure 3:
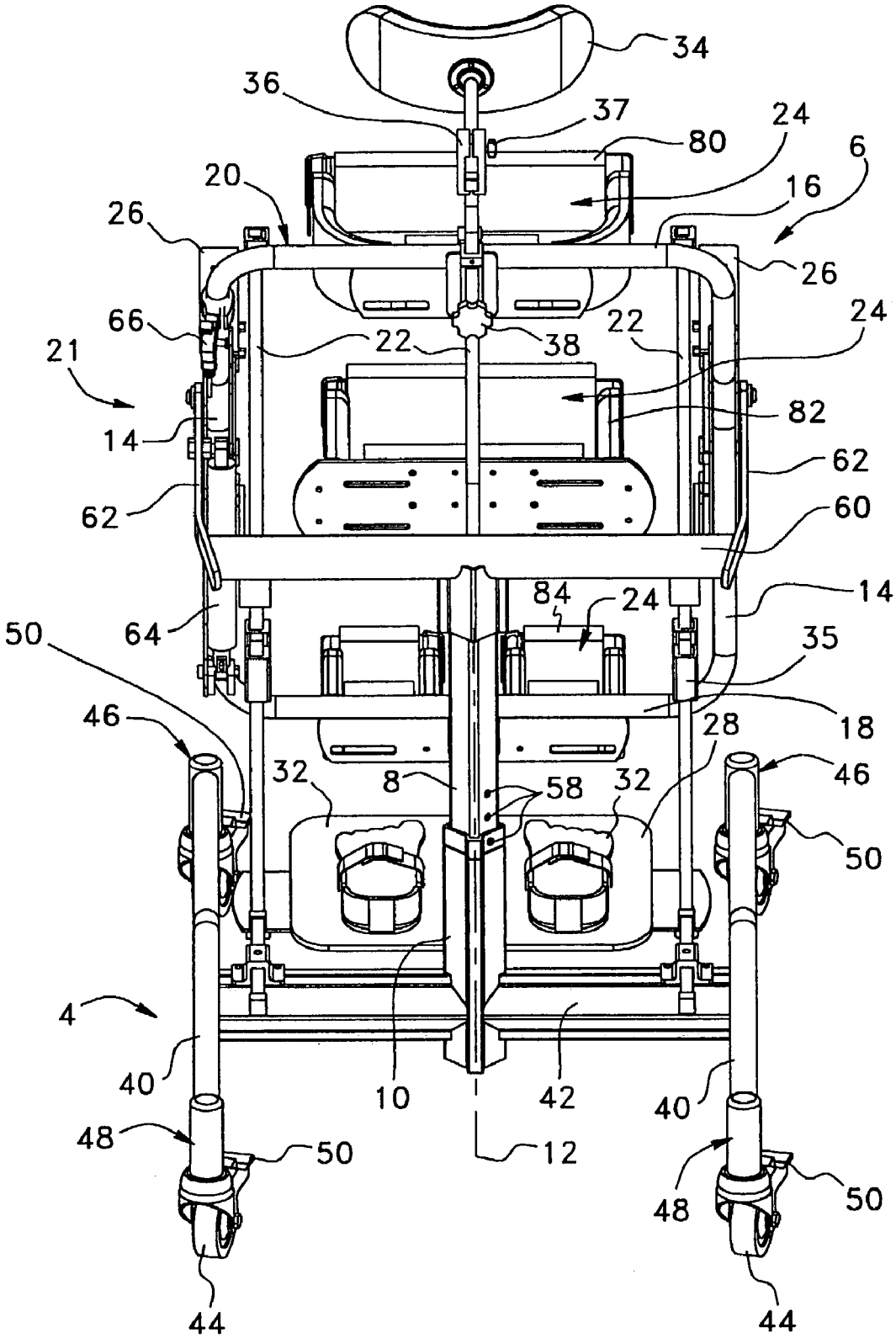
FIG. 3 is a schematic rear view of a stander according to the present invention.

Referring to FIGS. 1 and 2, the dismountable multi-position stander according to the present invention has a carriage 4, a body support assembly 6, and a mounting assembly 7 detachably mounting the body support assembly 6 onto the carriage 4 in a single coupling direction 12 as shown in FIG. 3. The mounting assembly 7 has upper and lower mounting elements 8, 10 respectively connected to the body support assembly 6 and the carriage 4 and detachably engaging with each other in the coupling direction (or course) 12. The lower and upper mounting elements 10, 8 are preferably the sole elements interconnecting the body support assembly 6 and the carriage 4 so that there are no additional elements to disconnect when dismounting the stander. Also, as there is only one coupling direction 12, there is no difficult alignment of various parts to be achieved when mounting the body support assembly 6 onto the carriage 4.

The upper and lower mounting elements 8, 10 may consist of a shaft member sliding in a tubular member so as to form a height adjustable telescopic arrangement. In the illustrated case, the shaft member forms the upper mounting element 8 and the tubular member forms the lower mounting element 10, but their position can be interchanged if desired. The upper and lower members 8, 10 of the mounting assembly 7 may also be formed otherwise, for example in a column, rail or runner-like arrangement, provided that it efficiently prevents the body support assembly 6 from falling sideways and operates following a single coupling direction when mounting and dismounting the body support assembly 6 from the carriage 4. The mounting assembly is preferably arranged to prevent involuntary disengagement of the upper and lower mounting elements 8, 10. The lower and upper mounting elements 10, 8 may be shaped so that the interlocking of both elements prevents the upper mounting element 8 from revolving within the lower mounting element 10, around the coupling axis 12. For example, the lower and upper mounting elements 10, 8 may have corresponding cross-shaped sections.

Figure 6:
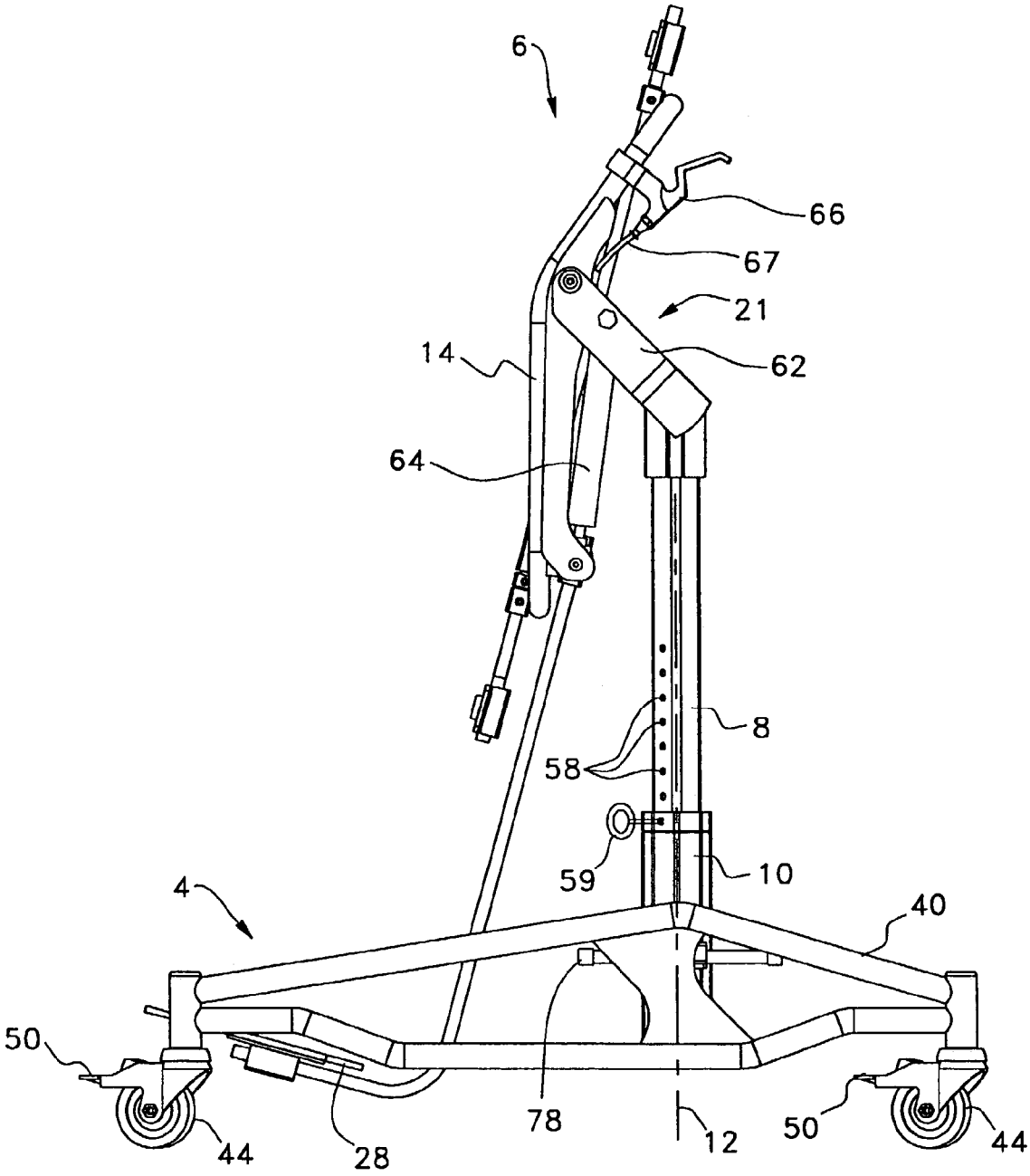
FIGS. 6 and 7 are schematic side views of a stander according to the present invention, in different operating positions, respectively.
Figure 7:
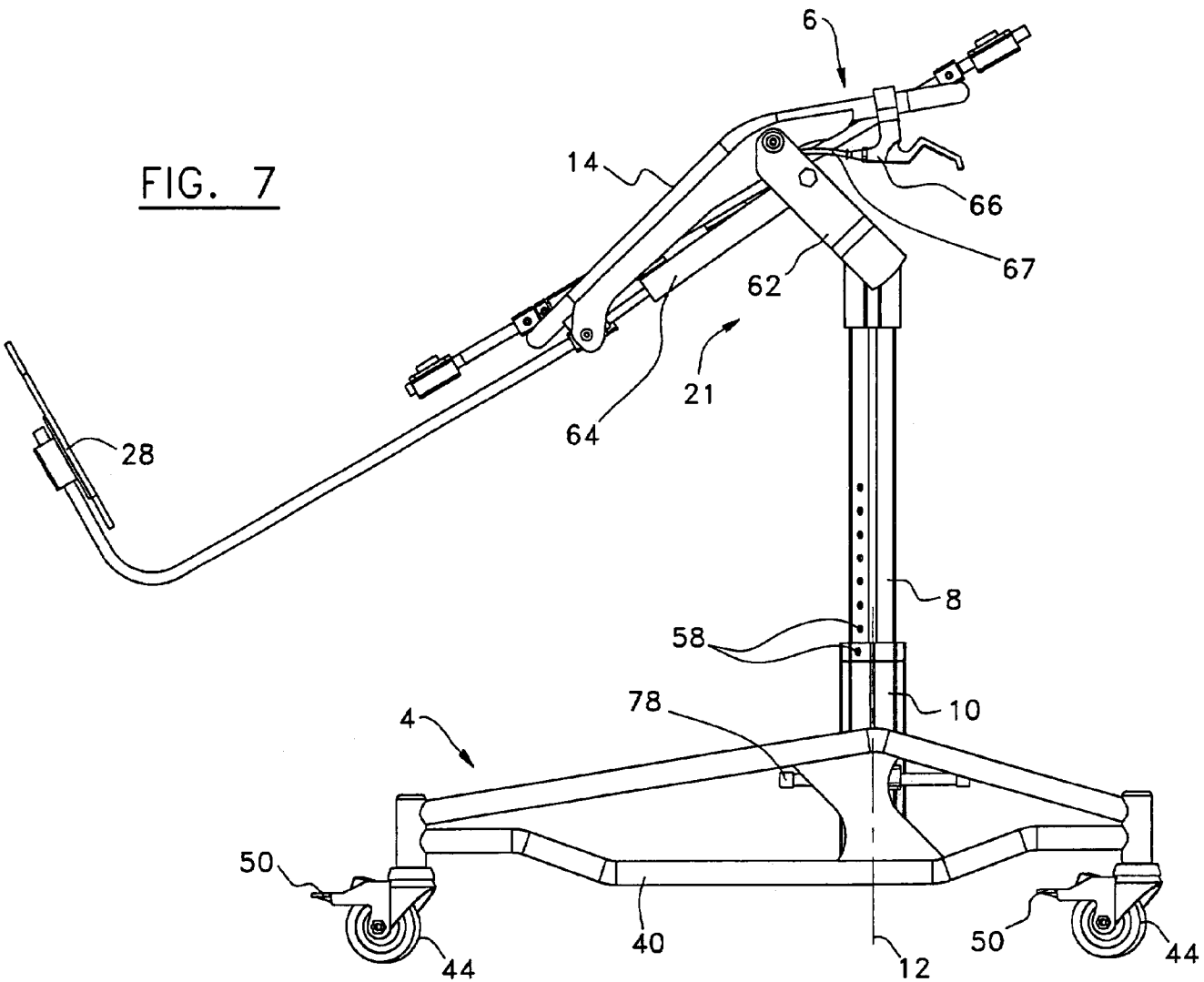

As best shown in FIG. 6, height adjustment and locking of the telescopic arrangement can be achieved with alignable transverse holes 58 in the tubular member 10 and the shaft member 8, and a pin 59 insertable through the holes 58 when aligned. Other kinds of adjustment or locking mechanisms can be used if desired, for example a simple tightening bolt, a pivoting pressure lever, etc.

Figure 10:
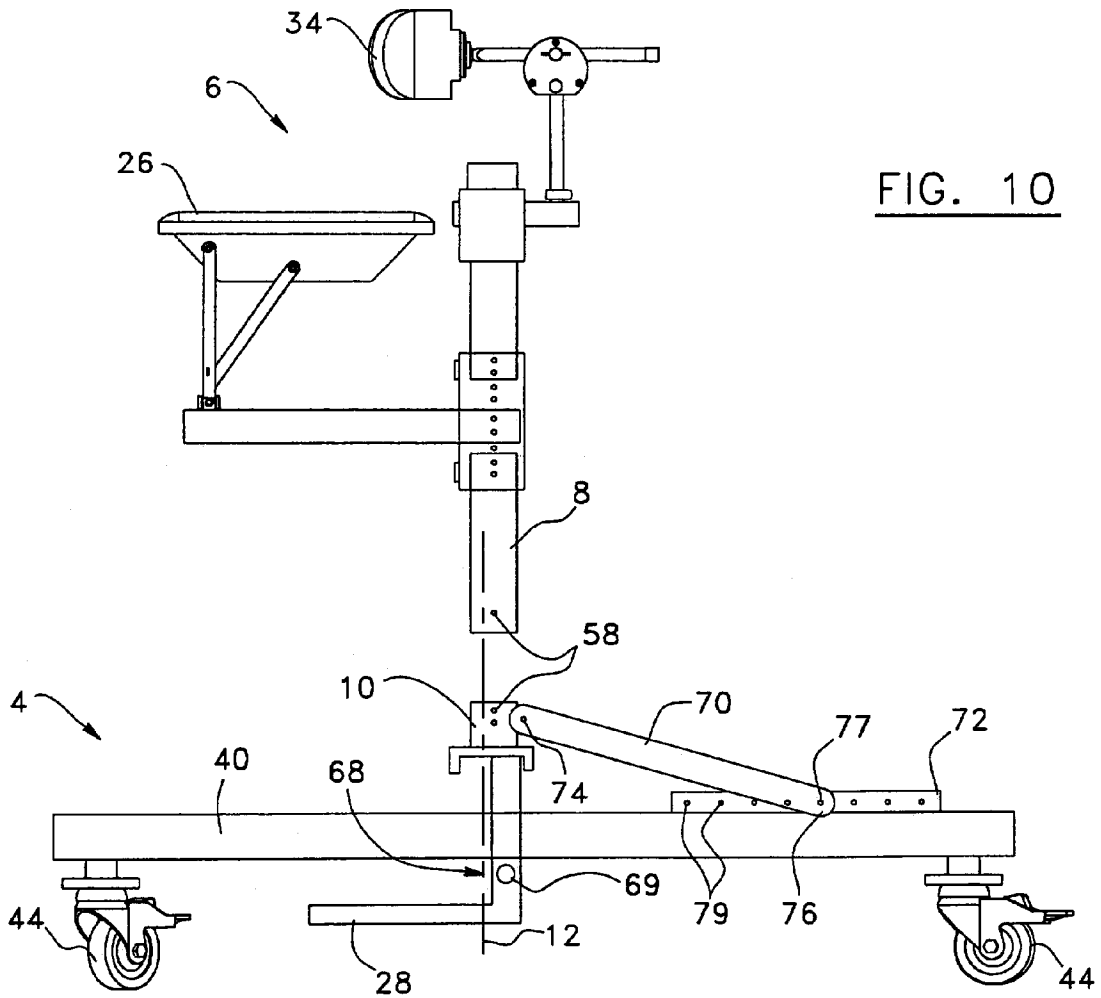
FIGS. 10 and 11 are schematic side and front views of a stander according to the present invention, with an angle adjustable mounting assembly.
Figure 11:
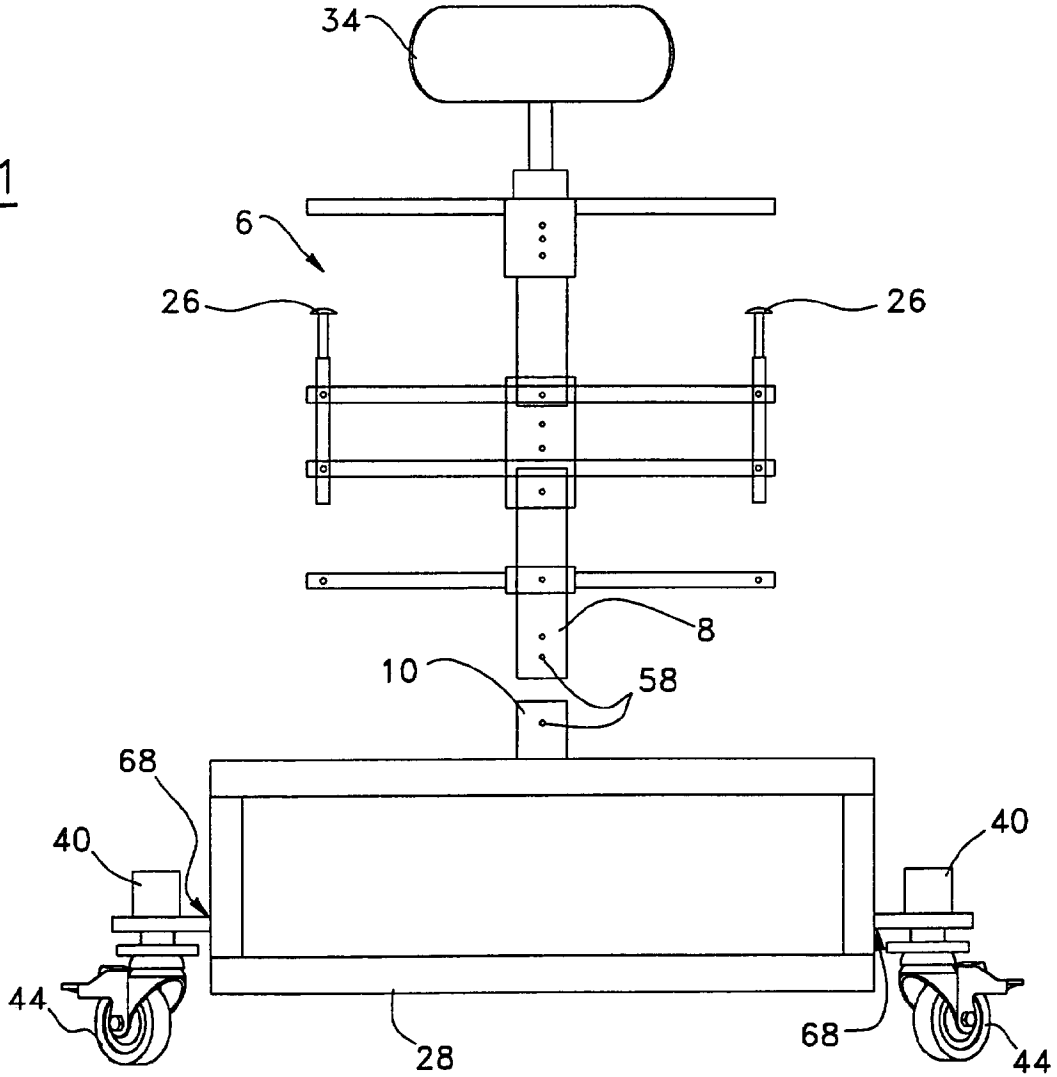

Although a single centered telescopic arrangement as illustrated is possibly the easier to align, the mounting assembly 7 may nevertheless consist of two telescopic arrangements (not shown) spaced from each other provided that their coupling axis is parallel with each other and thus in the same coupling direction. In the illustrated case, the coupling direction 12 extends in an upright or quasi-upright direction with respect to the carriage 4. But the coupling direction may extend in other directions depending on the design of the mounting assembly 7, and may even vary if a variable tilt angle arrangement is used as shown in FIGS. 10 and 11. For example, the coupling direction could extend totally crosswise with respect of the carriage 4 if desired although such a direction would require to move the body support assembly 6 also crosswise for mounting it onto the carriage 4, which would not be necessarily as easy to achieve as when the coupling direction is vertical or quasi-vertical, thus requiring simply to lower the body support assembly 6 in place. Also, a crosswise coupling direction would require the addition of a separate height adjusting mechanism for the body support assembly 6.

Referring to FIGS. 1–3 and 9, the body support assembly 6 is provided with body restraining elements 24 projecting on a front side of it and aligned together, unless the stander is intended for a user having sufficient upstanding capabilities. The body restraining elements 24 may consist of chest, waist and leg belts 80, 82, 84 aligned with one another and slideably mounted onto a frame 20 of the body support assembly 6. The belts 80, 82, 84 may be mounted onto rigid structures 81, 83, 85. Other kinds of body restraining elements can be used if desired, such as straps, jackets, braces, thongs, etc., which may be positioned elsewhere on the body support assembly 6. The body support assembly 6 can be further provided with an upper headrest 34 removably mounted onto the frame 20 and extending in alignment with the body restraining elements 24. Adjustment or removal of the headrest 34 can be made by appropriate turning of the knobs 37, 38 of the clamping brackets 36, 31. The body support assembly 6 can be also provided with a foot support 28 downwardly projecting from the frame 20, and two removable and/or foldable armrests 26 projecting on a front side of the assembly 6 (see e.g. FIG. 2 showing the armrests 26 in folded position). Different structures can be used to mount the restraining elements 24, the headrest 34 and the foot support 28 onto the frame 20. For example, elongated bars 22 extending between opposite transverse structural members 16, 18 of the frame 20 and attachment brackets 31, 33, 36, 37 sliding along the bars 22 can be used for this purpose. Various accessories can be also mounted on the body support assembly 6, for example a table, a food tray, a work platform (not shown) instead or onto the armrests 26, etc. The foot support 28 can be provided with foot restraints 32 if desired or necessary.

The frame 20 of the body support assembly 6 is pivotally connected to the upper mounting element 8 through a pivoting arrangement 21, so that the body support assembly 6 is pivotable at least between first and second tilt positions with respect to the carriage 4. The first and second tilt positions can be such that the body support assembly 6 extends upright or quasi upright on the carriage 4 when in the first position as shown in FIG. 1, and extends supine or quasi supine over the carriage 4 when in the second position as shown in FIG. 2. The supine position is useful for installing the user on the stander and attaching the user with the restraining elements 24 if necessary, before turning the body support assembly 6 in the upright position.

Referring to FIGS. 4, 5, 6 and 7, the pivoting arrangement 21 may be formed of a fork having a base member 60 (as shown in FIG. 3) from which the upper mounting element 8 downwardly projects, and opposite branch elements 62 projecting from the base member 60 and between which the body support assembly 6 is pivotally connected. For this purpose, opposite side bar members 14 of the frame 20 are pivotally connected respectively to the branch elements 62 of the fork.

The pivoting arrangement 21 is preferably provided with a dampening device such as a dampening cylinder 64 connected between the body support assembly 6 and the upper mounting element 8, e.g. between the fork and the frame 20, for limiting a pivoting speed of the body support assembly 6 about the upper mounting element 8. The dampening cylinder 64, may also conveniently be used for locking the body support assembly 6 in a fixed angular position with respect to the carriage 4 in the case where it is provided with a control valve system capable of locking the piston's position of the cylinder. For this purpose, a control lever 66 can be mounted onto one of the side bar members 14 of the body support assembly 6 for controlling operation of the dampening cylinder 64 through an appropriate cable 67 (operating as in a bicycle braking system).

Figure 9:
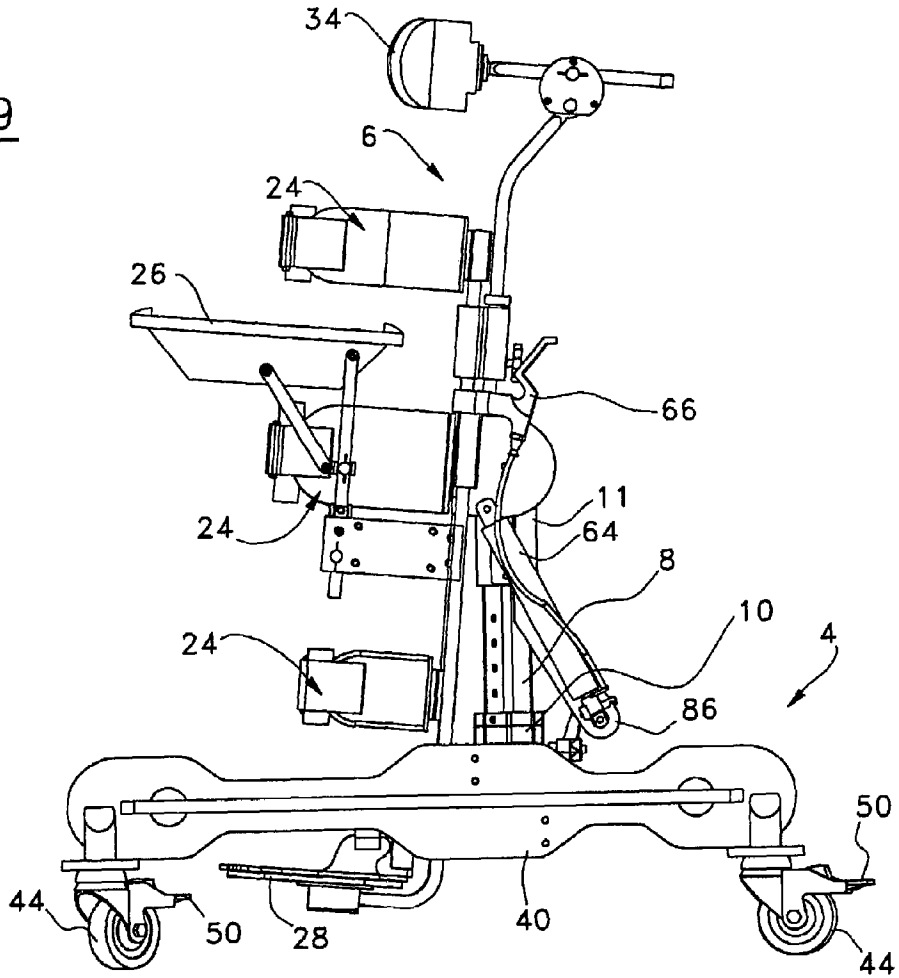
FIG. 9 is a schematic side view of a stander according to the present invention, with accessories.

Other kinds of dampening and locking devices can be used if desired, for example a simple spring-loaded pivot between the upper mounting element 8 and the frame 20, an independent lock structure between them, etc. The pivoting arrangement 21 may be located between the upper mounting element 8 and the fork or another replacement structure fastened to the frame 20 instead of being located between the fork and the frame 20, as shown in FIG. 9. The body support assembly 6 can thus be set at any desired angular position with respect to the carriage 4, as shown for example in FIG. 7.

Referring back to FIGS. 1 and 2, the carriage 4 has two opposite side members 40 and a transverse member 42 extending between the side members 40. The lower mounting element 10 upwardly projects from the transverse member 42 at an intermediary position between the side members 40. The side members 40 have front and rear ends 46, 48 which may conveniently be provided with casters 44 preferably having locking pedals 50. Casters, skates or other elements facilitating displacement of the stander can be omitted if it is intended for stationary use.

The side members 40 may have longer portions extending in front of the transverse member 42 than respective portions extending behind the transverse member 42. The transverse member 42 thus extends slightly off-centered and, due to the design of the body support assembly 6, the user lays in a center position on the stander for stability.

Figure 4:
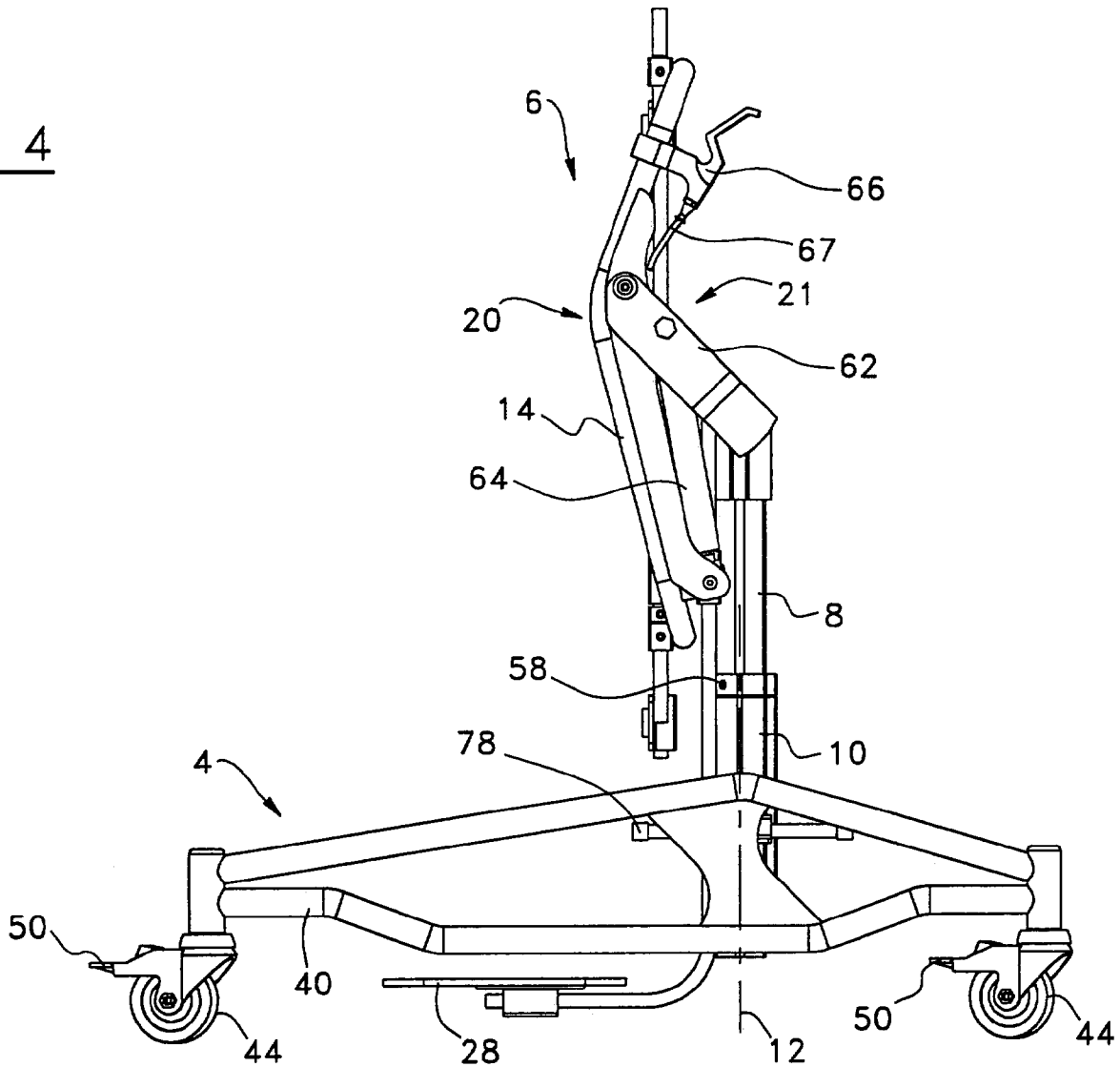
FIGS. 4 and 5 are schematic side views of a stander according to the present invention, in assembled and disassembled configurations, respectively.
Figure 5:
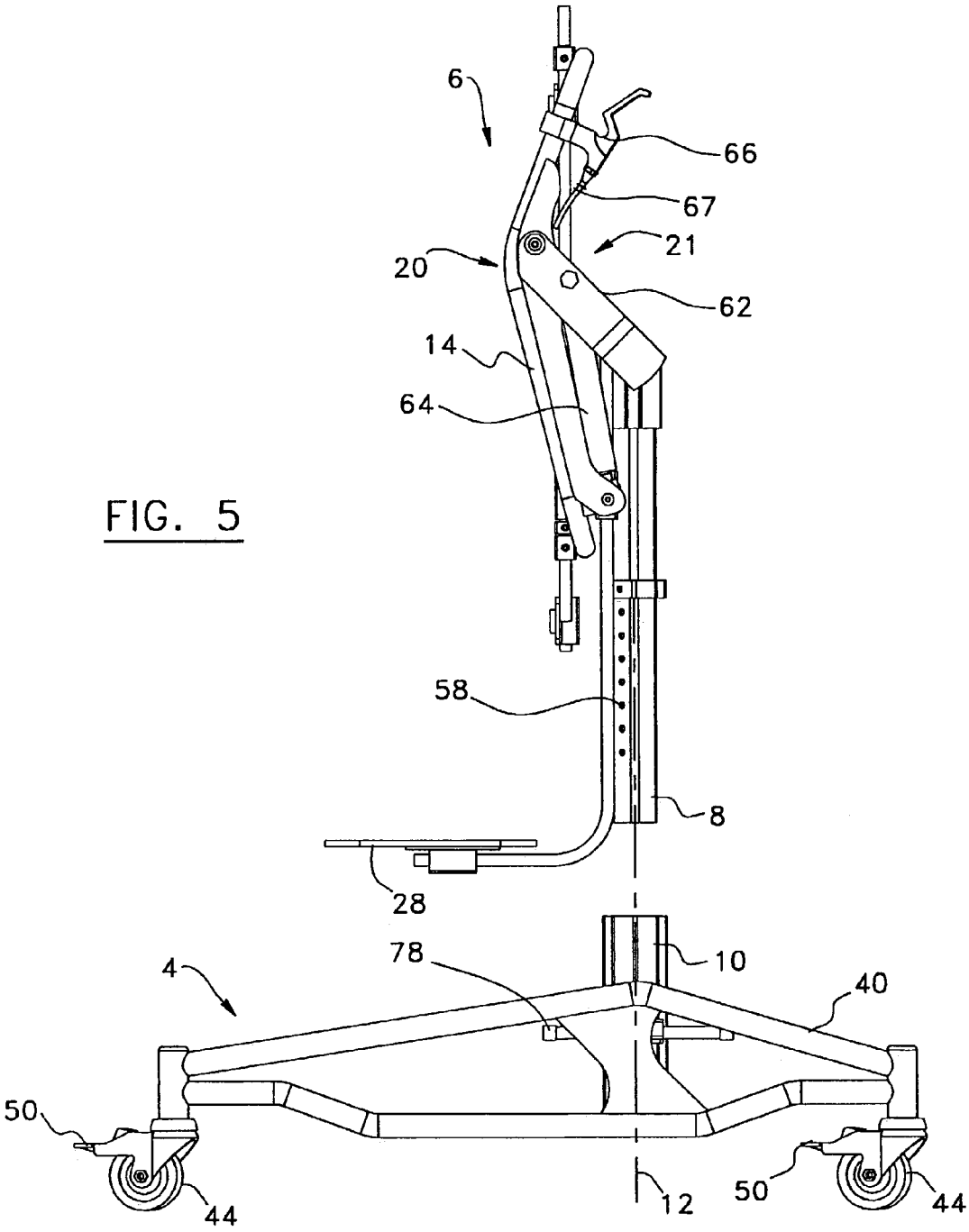

The carriage 4 has a front opened structure through which the foot support 28 extends when the body support assembly 6 is in upright position, as shown in FIG. 1. The foot support 28 slideably attached to the frame 20 preferably has a height adjustment range downwardly exceeding an underside of the front opened structure of the carriage 4, as is best shown in FIG. 4. As a result, the user may stand up close to the ground level in a more natural way in particular with respect to others.

The carriage 4 may be provided with one or two stop elements 78 providing a stopping surface for the foot support 28 against further pivoting of the body support assembly 6 past a desired angular position with respect to the carriage 4. Other stop arrangements can be provided, for example a stopping mechanism integrated in the pivoting arrangement 21.

Figure 8:
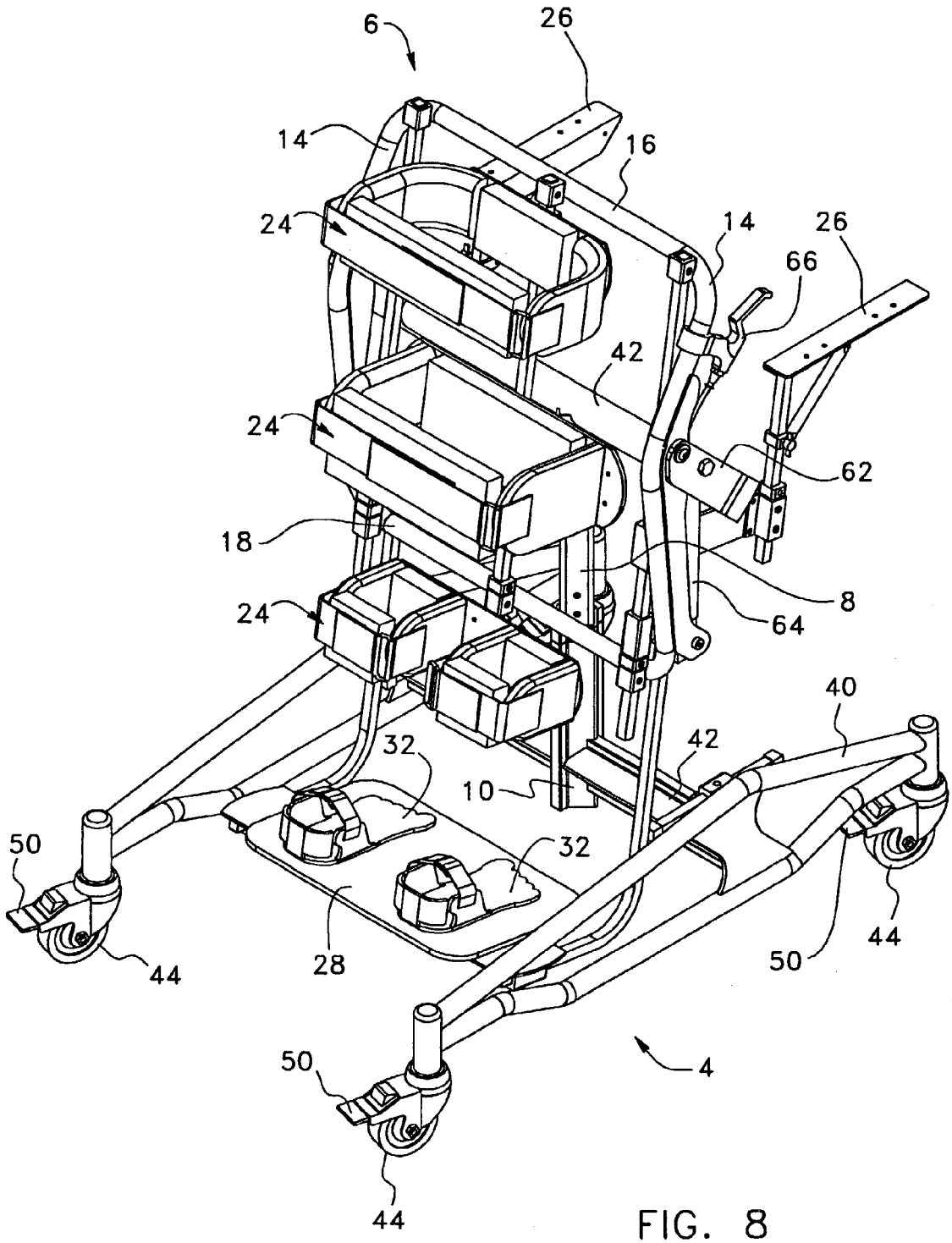
FIG. 8 is a schematic perspective view of a stander according to the present invention, in a prone support configuration.

Referring to FIG. 8, the foot support 28 and the armrests 26 can be mounted in reverse positions for providing prone support to a user.

Referring to FIG. 9, the structure and design of the carriage 4, of the mounting assembly and of the body support assembly 6 may vary depending on the desired look and functionalities. The mounting assembly may have an additional tubular member 11 slideably receiving an upper end of the shaft member 8. An extension arm 86 downwardly projecting from the additional tubular member 11 can be provided for mounting the dampening cylinder 64 behind the body support assembly 6 instead of in front.

Referring to FIGS. 10 and 11, the stander may be provided with a pivoting assembly 68 for adjusting an operative angle of the mounting assembly 8, 10 and, as a result, of the coupling direction 12. The pivoting assembly 68 can be formed of a transverse pivoting arrangement 69 between the lower mounting element 10 and the carriage 4, a support arm 70 having a first end 74 pivotally connected to the lower mounting element 10, and a second end 76, and a bracket 72 mounted onto the carriage 4 and receiving the second end 76 of the arm 70 at an adjustable distance from the lower mounting element 10 determining the operative angle of the mounting assembly. The attachment of the arm 70 to the bracket 72 can be made using a rod 77 inserted in one of the transverse bores 79 made in the bracket 72.

While embodiments of this invention have been illustrated in the accompanying drawings and described above, it will be evident to those skilled in the art that changes and modifications may be made therein without departing from the essence of this invention.

What is claimed is:

1. A dismountable multi-position stander comprising:

a carriage;

a body support assembly;

a mounting assembly detachably mounting the body support assembly onto the carriage in a single coupling direction, the mounting assembly having upper and lower mounting elements detachably engaging with each other in the coupling direction, the lower and upper mounting elements being respectively connected to the carriage and the body support assembly, and wherein the pivoting arrangement comprises:

a transverse pivoting arrangement between the lower mounting element and the carriage;

a support arm having a first end pivotally connected to the lower mounting element, and a second end; and a bracket mounted onto the carriage and receiving the second end of the arm at an adjustable distance from the lower mounting element determining the operative angle of the mounting assembly.

2. The dismountable multi-position stander according to claim 1, wherein the body support assembly comprises body restraining elements projecting on a front side thereof and aligned together.

3. The dismountable multi-position stander according to claim 2, wherein:

the body support assembly comprises a frame pivotally connected to the upper mounting element through the pivoting arrangement; and the body restraining elements comprise chest, waist and leg belts aligned with one another and slideably mounted onto the frame.

4. The dismountable multi-position stander according to claim 3, wherein the body support assembly further comprises an upper headrest removably mounted onto the frame and extending in alignment with the body restraining elements.

5. A dismountable multi-position stander comprising:

a carriage;

a body support assembly; and a mounting assembly detachably mounting the body support assembly onto the carriage in a single coupling direction, the mounting assembly having upper and lower mounting elements detachably engaging with each other in the coupling direction, the lower and upper mounting elements being respectively connected to the carriage and the body support assembly, wherein the body support assembly comprises two removable armrests projecting on a front side thereof.

6. A dismountable multi-position stander comprising:

a carriage;

a body support assembly;

a mounting assembly detachably mounting the body support assembly onto the carriage in a single coupling direction, the mounting assembly having upper and lower mounting elements detachably engaging with each other in the coupling direction, the lower and upper mounting elements being respectively connected to the carriage and the body support assembly, and a pivoting arrangement between the body support assembly and the upper mounting element, the body support assembly being pivotable between first and second tilt positions with respect to the carriage, wherein the body support assembly extends substantially upright on the carriage when in said first tilt position, and extends substantially supine over the carriage when in said second tilt position.

7. The dismountable multi-position stander according to claim 6, wherein one of the lower and upper mounting elements comprises a tubular member, and the other one of the lower and upper mounting elements comprises a shaft member sliding in the tubular member, the tubular and the shaft members forming a height adjustable telescopic arrangement.

8. The dismountable multi-position stander according to claim 7, wherein the tubular member forms the lower mounting element and the shaft member forms the upper mounting element.

9. The dismountable multi-position stander according to claim 8, wherein the coupling direction extends in a substantially upright direction with respect to the carriage.

10. A dismountable multi-position stander comprising:

a carriage;

a body support assembly;

a mounting assembly detachably mounting the body support assembly onto the carriage in a single coupling direction, the mounting assembly having upper and lower mounting elements detachably engaging with each other in the coupling direction, the lower and upper mounting elements being respectively connected to the carriage and the body support assembly, and a pivoting arrangement between the body support assembly and the upper mounting element, the body support assembly being pivotable between first and second tilt positions with respect to the carriage, wherein the pivoting arrangement comprises a fork having a base member from which the upper mounting element downwardly projects, and opposite branch elements projecting from the base member and between which the body support assembly is pivotally connected.

11. A dismountable multi-position stander comprising:

a carriage;

a body support assembly; and a mounting assembly detachably mounting the body support assembly onto the carriage in a single coupling direction, the mounting assembly having upper and lower mounting elements detachably engaging with each other in the coupling direction, the lower and upper mounting elements being respectively connected to the carriage and the body support assembly, wherein the carriage comprises two opposite side members and a transverse member extending between the side members, the lower mounting element upwardly projecting from the transverse member at an intermediary position between the side members.

12. The dismountable multi-position stander according to claim 11, wherein the side members of the carriage have front and rear ends provided with casters.

13. The dismountable multi-position stander according to claim 11, wherein the side members have longer portions extending in front of the transverse member than respective portions extending behind the transverse member.

14. The dismountable multi-position stander according to claim 7, wherein the telescopic arrangement further comprises height adjustment means for locking the shaft member at a desired height inside the tubular member.

15. The dismountable multi-position stander according to claim 14, wherein the height adjustment means comprises alignable transverse holes in the tubular member and the shaft member, and a pin insertable through the holes when aligned.

16. The dismountable multi-position stander according to claim 6, wherein the pivoting arrangement comprises a dampening means for limiting a pivoting speed of the body support assembly about the upper mounting element.

17. The dismountable multi-position stander according to claim 6, wherein the pivoting arrangement comprises a locking means for locking the body support assembly in a fixed angular position with respect to the carriage.

18. The dismountable multi-position stander according to claim 17, wherein the pivoting arrangement further comprises a dampening means for limiting a pivoting speed of the body support assembly about the upper mounting element.

19. The dismountable multi-position stander according to claim 18, wherein the locking means and the dampening means commonly comprise a dampening cylinder connected between the body support assembly and the upper mounting element, and a control lever mounted onto the body support assembly and controlling operation of the dampening cylinder.

20. The dismountable multi-position stander according to claim 10, wherein:

the body support assembly comprises a rectangular bar frame having opposite side bar members pivotally connected respectively to the branch elements of the fork; and the pivoting arrangement comprises a dampening cylinder connected between the fork and the bar frame, and a control lever mounted onto one of the side bar members and controlling operation of the dampening cylinder.

21. The dismountable multi-position stander according to claim 6, wherein:

the body support assembly comprises a frame pivotally connected to the upper mounting element through the pivoting arrangement, and a foot support downwardly projecting from the frame; and the carriage has a front opened structure through which the foot support extends when the body support assembly is in said first position.

22. The dismountable multi-position stander according to claim 21, wherein the foot support is slideably attached to the frame and has a height adjustment range downwardly exceeding an underside of the front opened structure of the carriage.

23. The dismountable multi-position stander according to claim 21, wherein the carriage comprises at least one stop element providing a stopping surface for the foot support against further pivoting of the body support assembly past said first position.

* * * * *